US010110989B2

(12) United States Patent
Alexander

(10) Patent No.: US 10,110,989 B2
(45) Date of Patent: Oct. 23, 2018

(54) LOUDSPEAKER DESIGN

(71) Applicant: Eric Jay Alexander, Orem, UT (US)

(72) Inventor: Eric Jay Alexander, Orem, UT (US)

( * ) Notice: Subject to any disclaimer, the term of this patent is extended or adjusted under 35 U.S.C. 154(b) by 0 days.

(21) Appl. No.: 15/410,744

(22) Filed: Jan. 19, 2017

(65) Prior Publication Data

US 2017/0208385 A1 Jul. 20, 2017

Related U.S. Application Data

(60) Provisional application No. 62/280,621, filed on Jan. 19, 2016.

(51) Int. Cl.

| | |
|---|---|
| ***H04R 1/20*** | (2006.01) |
| ***H04R 1/24*** | (2006.01) |
| ***H04R 1/02*** | (2006.01) |

(52) U.S. Cl.

CPC ..... *H04R 1/24* (2013.01); *H04R 1/025* (2013.01); *H04R 2201/403* (2013.01)

(58) Field of Classification Search

CPC ..... H04R 1/025; H04R 1/24; H04R 2201/403
USPC ..... 381/150, 345, 349, 351, 386, 387
See application file for complete search history.

(56) References Cited

U.S. PATENT DOCUMENTS

| | | | | |
|---|---|---|---|---|
| 4,882,760 | A * | 11/1989 | Yee | H04R 1/227 181/199 |
| 7,260,235 | B1 * | 8/2007 | Henricksen | H04R 1/403 181/199 |
| 2002/0146140 | A1 * | 10/2002 | Chiu | H04R 1/02 381/332 |
| 2005/0063559 | A1 * | 3/2005 | Lee | H04R 1/025 381/335 |

* cited by examiner

*Primary Examiner* — Brian Ensey
(74) *Attorney, Agent, or Firm* — Adam D. Stevens; Kirton McConkie

(57) ABSTRACT

A loudspeaker includes a first vertically disposed array of drivers contained in a first enclosure, a second vertically disposed array of drivers contained in a second enclosure, and a third vertically disposed array of drivers contained in a third enclosure, wherein the third enclosure is located horizontally between the first and second enclosures.

20 Claims, 6 Drawing Sheets

LOUDSPEAKER DESIGN

CROSS-REFERENCE TO RELATED APPLICATIONS

This application claims the benefit of U.S. Provisional Application No. 62/280,621, filed Jan. 19, 2016, which is incorporated herein by reference.

BACKGROUND OF THE INVENTION

1. Field of the Invention

The present invention relates to sound reproduction, and more particularly to loudspeaker design.

2. Background and Related Art

A loudspeaker is a device that converts an electrical audio signal into a corresponding sound. Loudspeakers commonly use electroacoustic transducers or drivers that use an alternating current applied to a voice coil in conjunction with a permanent magnet to cause an attached diaphragm to move back and forth, pushing on air to create sound waves. The transducers of loudspeakers are commonly housed in an enclosure that helps control the quality of the sound reproduced by the various speaker components. In many instances, a loudspeaker may have multiple individual transducers or drivers reproducing different frequencies of sound. Loudspeakers are used to reproduce sound for music, movies, events, and many other purposes. Ongoing efforts continue to design loudspeakers that are better able to reproduce the sounds they are intended to reproduce.

BRIEF SUMMARY OF THE INVENTION

Implementations of the invention provide loudspeakers having favorable characteristics for sound reproduction. According to certain implementations, an exemplary loudspeaker includes a first vertically disposed array of drivers contained in a first enclosure, a second vertically disposed array of drivers contained in a second enclosure, and a third vertically disposed array of drivers contained in a third enclosure, wherein the third enclosure is located horizontally between the first and second enclosures.

The first vertically disposed array of drivers and the second vertically disposed array of drivers may be directed off-axis from a primary direction or axis of the third vertically disposed array of drivers. For example, the first vertically disposed array of drivers and the second vertically disposed array of drivers may each be directed at opposite angles from the primary direction of the third vertically disposed array of drivers at an angle of between about fifteen degrees and about thirty degrees from the primary direction of the third vertically disposed array of drivers. As another example, the first vertically disposed array of drivers and the second vertically disposed array of drivers may each be directed at opposite angles from the primary direction of the third vertically disposed array of drivers at an angle of between about twenty degrees and about twenty-five degrees from the primary direction of the third vertically disposed array of drivers. As another example, the first vertically disposed array of drivers and the second vertically disposed array of drivers may each be directed at opposite angles from the primary direction of the third vertically disposed array of drivers at an angle of about twenty-two and one-half degrees from the primary direction of the third vertically disposed array of drivers.

The third vertically disposed array of drivers may be recessed relative to the first vertically disposed array of drivers and the second vertically disposed array of drivers to cause impulses from the first, second, and third vertically disposed arrays of drivers to arrive at an on-axis listening position simultaneously.

The first vertically disposed array of drivers and the second vertically disposed array of drivers may include drivers such as midrange drivers or mid-bass drivers. The third vertically disposed array of drivers may include drivers such as tweeters or super tweeters.

The first vertically disposed array of drivers and the second vertically disposed array of drivers may all be drivers of a single type and size. The third vertically disposed array of drivers may include a single vertically centered super tweeter and equal numbers of a single type and size of tweeters above and below the super tweeter.

The loudspeaker may include a subwoofer located below the first, second, and third vertically disposed arrays of drivers.

The first and second enclosures may be ported. The first and second enclosures may each include a generally outward-firing port for each of the drivers contained in the first and second enclosures. The first and second enclosures may each include dividers between each of the drivers in the respective vertically disposed array of drivers.

The first vertically disposed array of drivers and the second vertically disposed array of drivers may each include an equal number of drivers from two to eight drivers per array, and the third vertically disposed array of drivers may include a number of drivers from four to seventeen drivers. The first vertically disposed array of drivers and the second vertically disposed array of drivers may include drivers having a first, lower fundamental frequency, while the third vertically disposed array of drivers may include drivers having a second fundamental frequency that is higher than the first, lower fundamental frequency. The third vertically disposed array of drivers may include a number of drivers having the second fundamental frequency that is equal to a sum of the drivers having the first, lower fundamental frequency in the first and second vertically disposed array of drivers. The third vertically disposed array of drivers may further include a driver having a third fundamental frequency that is higher than the second fundamental frequency.

According to further implementations of the invention, a loudspeaker includes a first vertically disposed array of drivers, a second vertically disposed array of drivers, and a third vertically disposed array of drivers disposed in a vertically oriented space horizontally located between the first and second vertically disposed arrays of drivers, wherein the first vertically disposed array of drivers and the second vertically disposed array of drivers are directed off-axis from a primary direction of the third vertically disposed array of drivers. The first vertically disposed array of drivers and the second vertically disposed array of drivers may each be directed at opposite angles from the primary direction of the third vertically disposed array of drivers at an angle of between about fifteen degrees and about thirty degrees from the primary direction of the third vertically disposed array of drivers. The first vertically disposed array of drivers and the second vertically disposed array of drivers may each be directed at opposite angles from the primary direction of the third vertically disposed array of drivers at an angle of about twenty-two and one-half degrees from the primary direction of the third vertically disposed array of drivers.

BRIEF DESCRIPTION OF THE SEVERAL VIEWS OF THE DRAWINGS

The objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described and explained with additional specificity and detail through the use of the accompanying drawings in which:

DETAILED DESCRIPTION OF THE INVENTION

Figure 1:
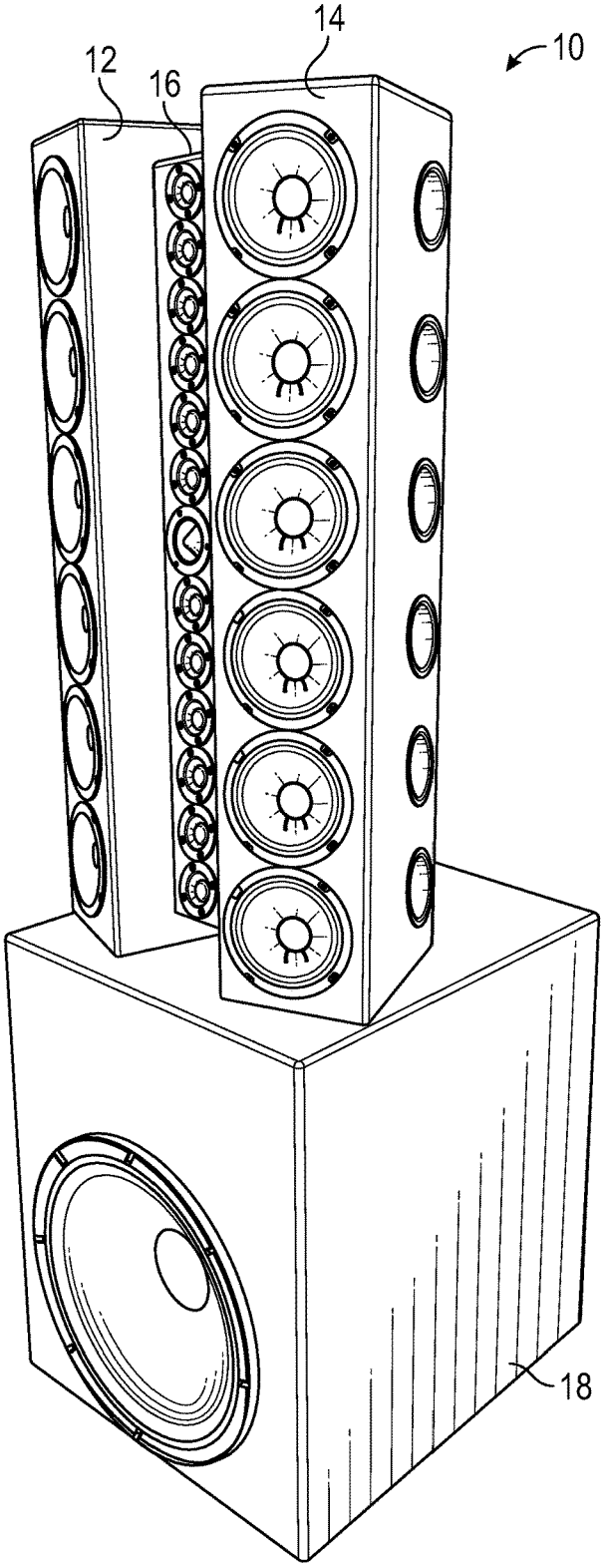
FIG. 1 shows a perspective view of a representative loudspeaker.

A description of embodiments of the present invention will now be given with reference to the Figures. It is expected that the present invention may take many other forms and shapes, hence the following disclosure is intended to be illustrative and not limiting, and the scope of the invention should be determined by reference to the appended claims.

Embodiments of the invention provide loudspeakers having favorable characteristics for sound reproduction. According to certain embodiments, an exemplary loudspeaker includes a first vertically disposed array of drivers contained in a first enclosure, a second vertically disposed array of drivers contained in a second enclosure, and a third vertically disposed array of drivers contained in a third enclosure, wherein the third enclosure is located horizontally between the first and second enclosures.

The first vertically disposed array of drivers and the second vertically disposed array of drivers may be directed off-axis from a primary direction or axis of the third vertically disposed array of drivers. For example, the first vertically disposed array of drivers and the second vertically disposed array of drivers may each be directed at opposite angles from the primary direction of the third vertically disposed array of drivers at an angle of between about fifteen degrees and about thirty degrees from the primary direction of the third vertically disposed array of drivers. As another example, the first vertically disposed array of drivers and the second vertically disposed array of drivers may each be directed at opposite angles from the primary direction of the third vertically disposed array of drivers at an angle of between about twenty degrees and about twenty-five degrees from the primary direction of the third vertically disposed array of drivers. As another example, the first vertically disposed array of drivers and the second vertically disposed array of drivers may each be directed at opposite angles from the primary direction of the third vertically disposed array of drivers at an angle of about twenty-two and one-half degrees from the primary direction of the third vertically disposed array of drivers.

The third vertically disposed array of drivers may be recessed relative to the first vertically disposed array of drivers and the second vertically disposed array of drivers to cause impulses from the first, second, and third vertically disposed arrays of drivers to arrive at an on-axis listening position simultaneously.

The first vertically disposed array of drivers and the second vertically disposed array of drivers may include drivers such as midrange drivers or mid-bass drivers. The third vertically disposed array of drivers may include drivers such as tweeters or super tweeters.

The first vertically disposed array of drivers and the second vertically disposed array of drivers may all be drivers of a single type and size. The third vertically disposed array of drivers may include a single vertically centered super tweeter and equal numbers of a single type and size of tweeters above and below the super tweeter.

The loudspeaker may include a subwoofer located below the first, second, and third vertically disposed arrays of drivers.

The first and second enclosures may be ported. The first and second enclosures may each include a generally outward-firing port for each of the drivers contained in the first and second enclosures. The first and second enclosures may each include dividers between each of the drivers in the respective vertically disposed array of drivers.

The first vertically disposed array of drivers and the second vertically disposed array of drivers may each include an equal number of drivers from two to eight drivers per array, and the third vertically disposed array of drivers may include a number of drivers from four to seventeen drivers. The first vertically disposed array of drivers and the second vertically disposed array of drivers may include drivers having a first, lower fundamental frequency, while the third vertically disposed array of drivers may include drivers having a second fundamental frequency that is higher than the first, lower fundamental frequency. The third vertically disposed array of drivers may include a number of drivers having the second fundamental frequency that is equal to a sum of the drivers having the first, lower fundamental frequency in the first and second vertically disposed array of drivers. The third vertically disposed array of drivers may further include a driver having a third fundamental frequency that is higher than the second fundamental frequency.

According to further embodiments of the invention, a loudspeaker includes a first vertically disposed array of drivers, a second vertically disposed array of drivers, and a third vertically disposed array of drivers disposed in a vertically oriented space horizontally located between the first and second vertically disposed arrays of drivers, wherein the first vertically disposed array of drivers and the second vertically disposed array of drivers are directed off-axis from a primary direction of the third vertically disposed array of drivers. The first vertically disposed array of drivers and the second vertically disposed array of drivers may each be directed at opposite angles from the primary direction of the third vertically disposed array of drivers at an angle of between about fifteen degrees and about thirty degrees from the primary direction of the third vertically disposed array of drivers. The first vertically disposed array of drivers and the second vertically disposed array of drivers may each be directed at opposite angles from the primary direction of the third vertically disposed array of drivers at an angle of about twenty-two and one-half degrees from the primary direction of the third vertically disposed array of drivers.

Figure 2:
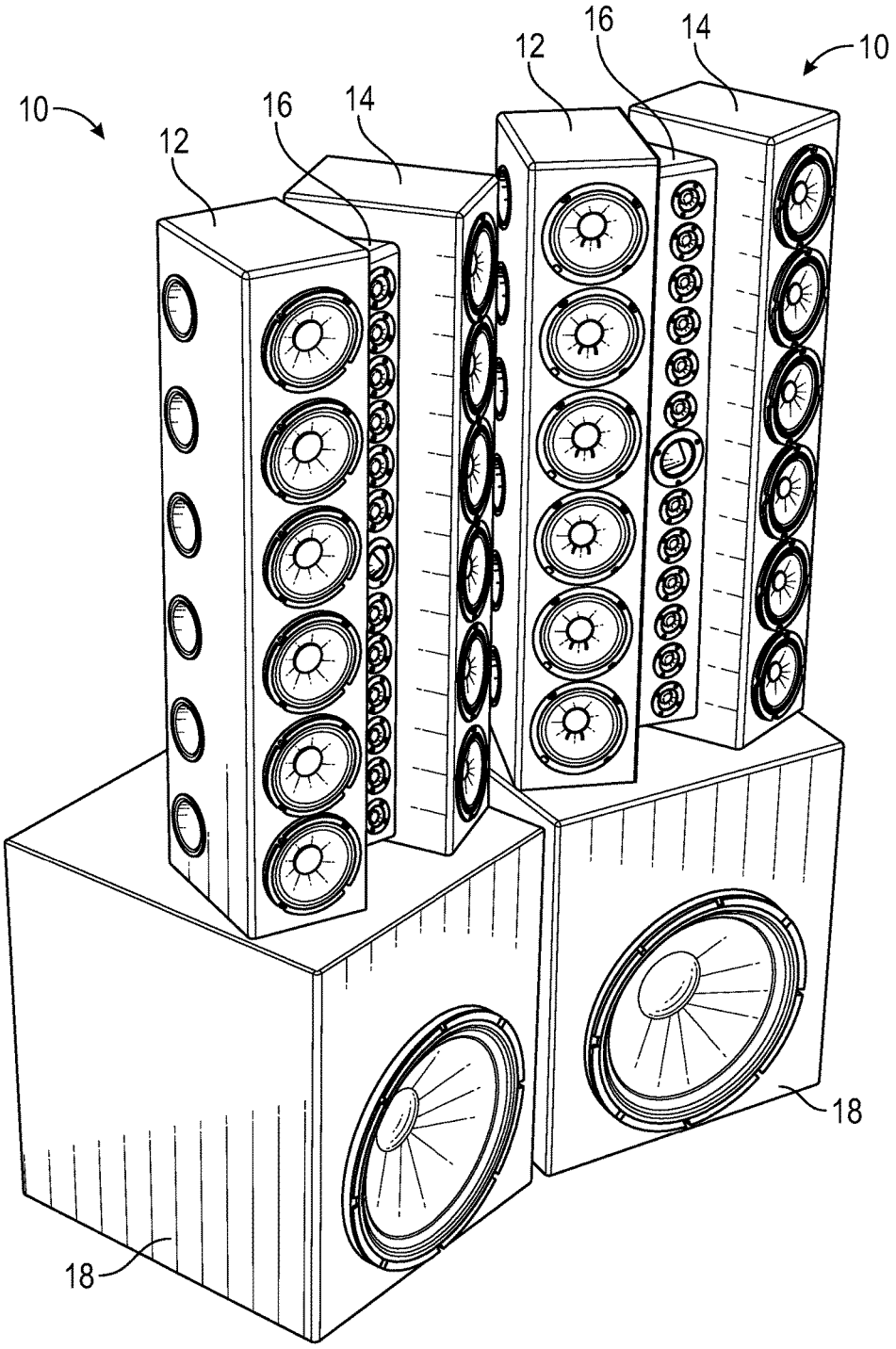
FIG. 2 shows a perspective view of a pair of representative loudspeakers.
Figure 3:
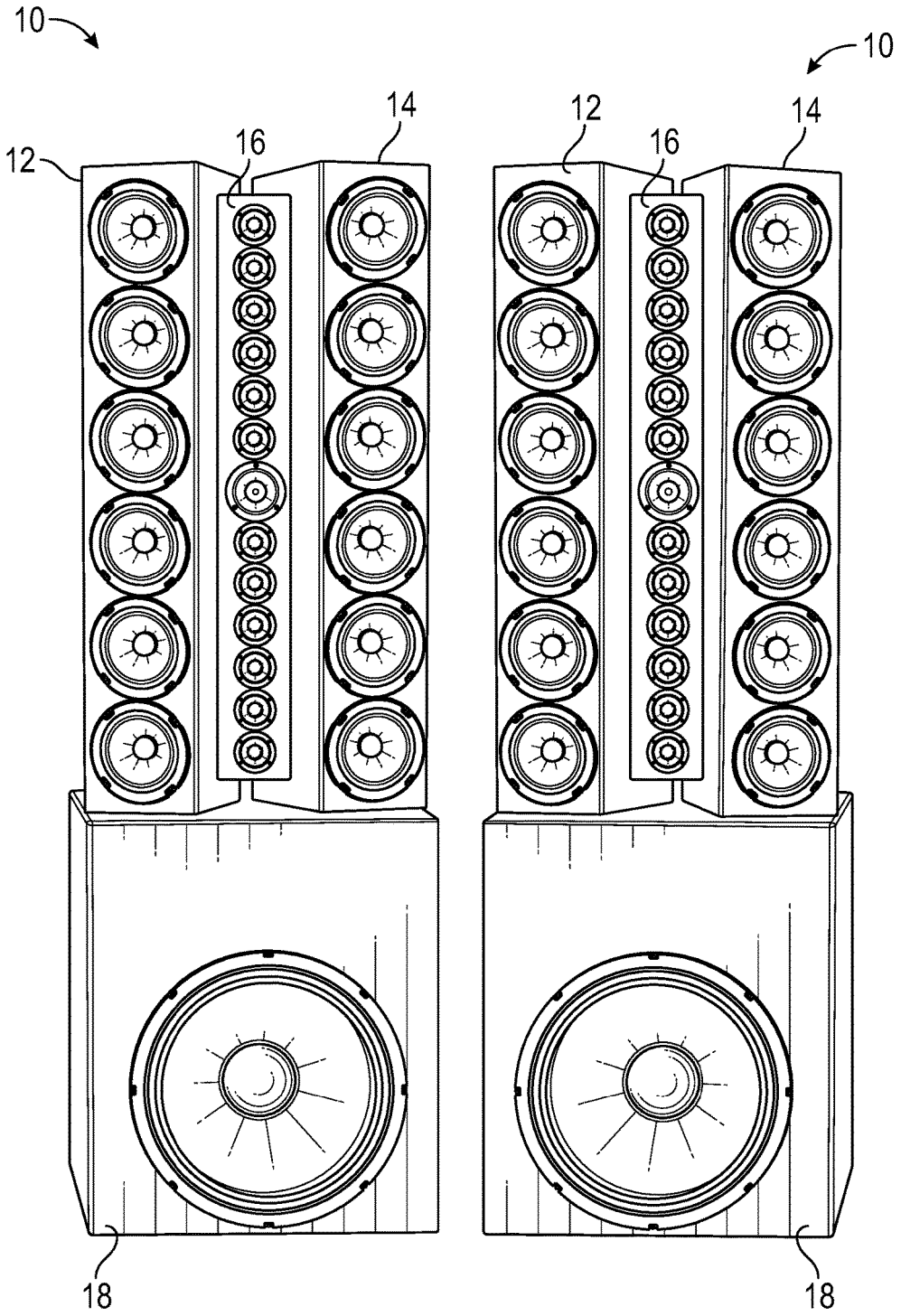
FIG. 3 shows a generally front view of a pair of representative loudspeakers.

FIGS. 1-3 show various views of a representative loudspeaker 10 in accordance with embodiments of the invention. The representative loudspeaker 10 includes a first vertically disposed array of drivers in a first enclosure 12, a second vertically disposed array of drivers in a second enclosure 14, and a third vertically disposed array of drivers in a third enclosure 16. The loudspeaker 10 also includes a subwoofer in a subwoofer enclosure 18. The first vertically disposed array of drivers and the first enclosure 12 are directed outward of a primary axis of the loudspeaker 10, in this example approximately twenty-two and one-half degrees, while the second vertically disposed array of drivers and the second enclosure 14 are also directed outward of the primary axis of the loudspeaker 10 approximately twenty-two and one-half degrees, but in the opposite direction.

The outward orientation of the first and second vertical arrays of drivers and enclosures creates a central void or space that receives the third vertical array of drivers, and allows the third vertical array of drivers to be recessed relative to the first and second vertically disposed arrays of drivers, allowing for sounds produced by the various arrays of drivers to be time-aligned at a listening position for the loudspeaker 10, such as at an on-axis listening position. While in this example, the first and second arrays of drivers are directed outward at an angle of approximately twenty-two and one-half degrees, the angle selected may be varied based on characteristics of the various selected drivers, such as the on-axis frequency response and the directivity of the selected drivers in the first and second vertically disposed arrays of drivers.

In the illustrated loudspeaker 10, each of the drivers in the first and second vertically disposed arrays of drivers is of a same type and size. In this example, each of the drivers in the first and second vertically disposed arrays of drivers is a six and one-half inch mid-bass driver, and there are six such drivers in each array. Meanwhile, the third vertically disposed array of drivers includes a centrally located compression diaphragm super tweeter (otherwise known as a bullet super tweeter), with twelve one-inch soft-dome tweeters—six above and six below the super tweeter. The subwoofer is a single eighteen-inch driver.

The subwoofer enclosure 18 in this example has an internal volume of approximately nine cubic feet. The overall height of the loudspeaker 10 is seventy-two inches, the width of the loudspeaker is twenty-three inches, and the depth is twenty-six inches. The enclosures for each of the first and second vertically disposed arrays of drivers are approximately forty-two inches by eight inches by eleven inches, and there are generally outward-firing vents for each of the mid-bass drivers. The enclosure for the third vertically disposed array of drivers is about four and one-half inches wide, approximately thirty-eight inches tall, and approximately one inch deep. The exemplary loudspeaker 10 has crossover frequencies of 300 Hz, 3 kHz, and 12 kHz. The loudspeaker 10 of this example is capable of achieving 138 dB with no compression.

As may be seen in FIGS. 1-3, the enclosures 12, 14 for the first and second vertically disposed arrays of drivers includes individual generally outward-firing ports for each driver in the arrays. While not shown, these enclosures 12, 14 may optionally be subdivided, with dividers placed between pairs of drivers, or between each driver. Optionally, each of the enclosures 12, 14 may be common enclosures with shared ports.

The setting of the mid-bass drivers off-axis widens the horizontal coverage pattern of the loudspeaker 10. Simultaneously, the loudspeaker achieves a very linear on-axis response because the mid-bass drivers are directional and are more linear off-axis.

As may be recognized from FIGS. 1-3, each loudspeaker 10 has the same number of mid-bass drivers (split between the first and second arrays) as tweeters (all located in the third, central, array). In this example, each loudspeaker 10 has twelve mid-bass drivers and twelve tweeters. Alternate versions of the speaker embrace the use of different numbers of mid-bass drivers and tweeters in the various arrays. Without limiting the possible configurations of drivers embraced by the claims appended hereto, other exemplary loudspeakers may have six mid-bass drivers (three in each array) and six tweeters, eight mid-bass drivers (four in each array) and eight tweeters, ten mid-bass drivers (five in each array) and ten tweeters, etc. Additionally, other configurations may have differing numbers of mid-bass or midrange drivers and tweeters, such as ten mid-bass drivers (five in each array) and eight tweeters, etc. Still other configurations may include additional super tweeters or no super tweeters.

While embodiments of the invention have been described wherein each vertically disposed array of drivers is located within its own enclosure, it should be recognized that various arrays of drivers may optionally share enclosures.

Figure 4:
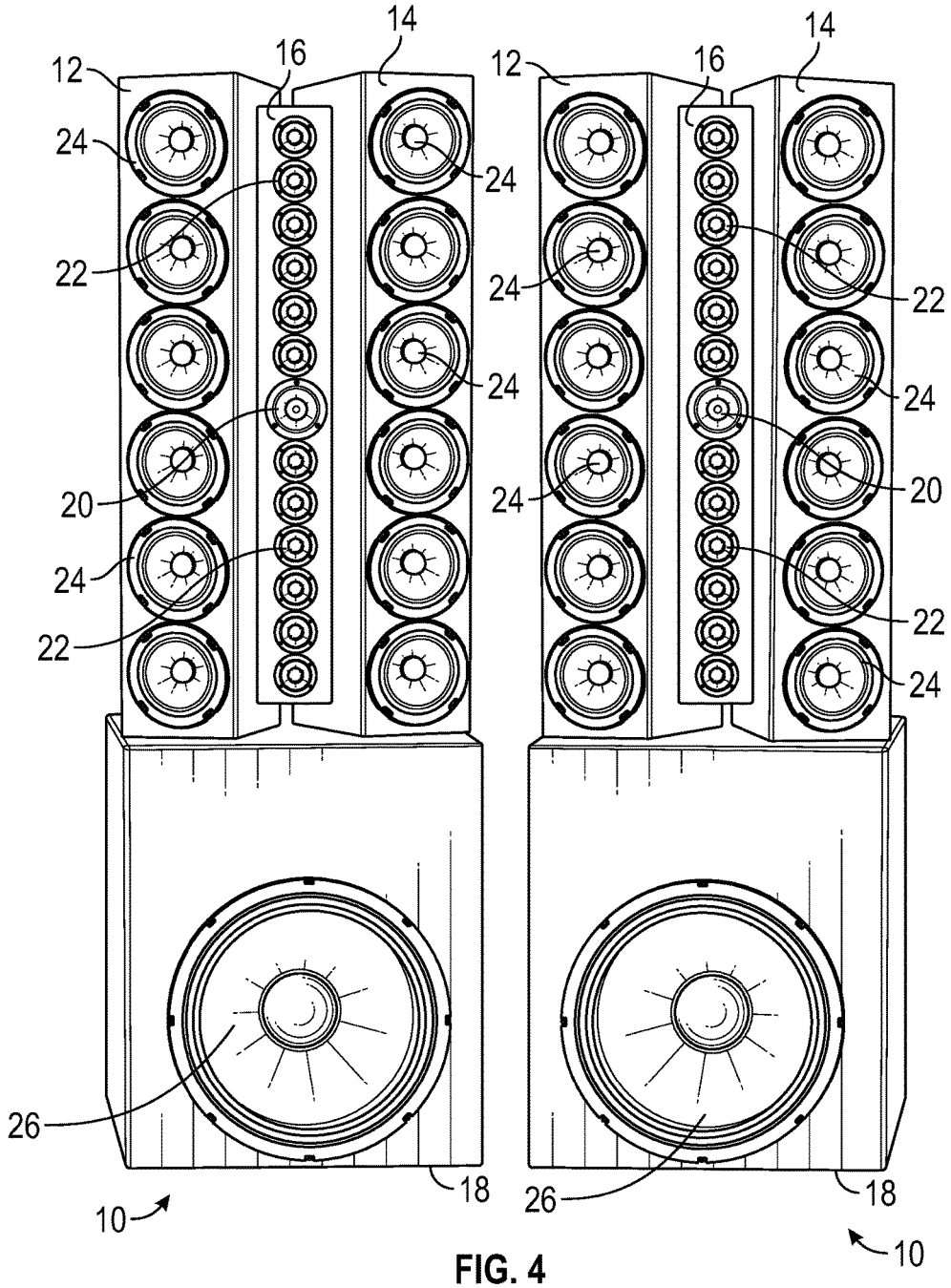
FIG. 4 shows a generally front view of a pair of representative loudspeakers.
Figure 5:
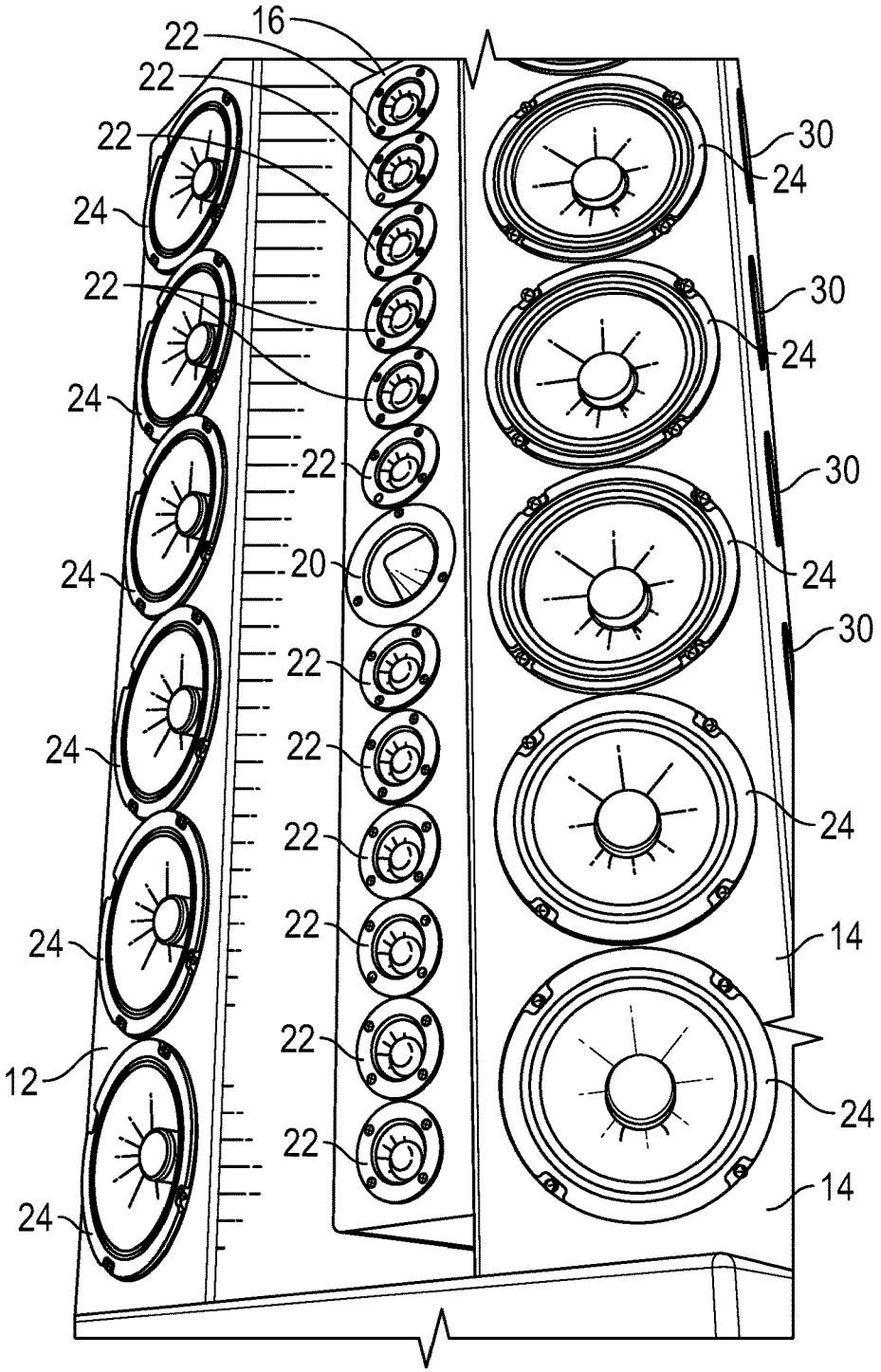
FIG. 5 shows a perspective view of vertically disposed arrays of drivers in a representative loudspeaker.
Figure 6:
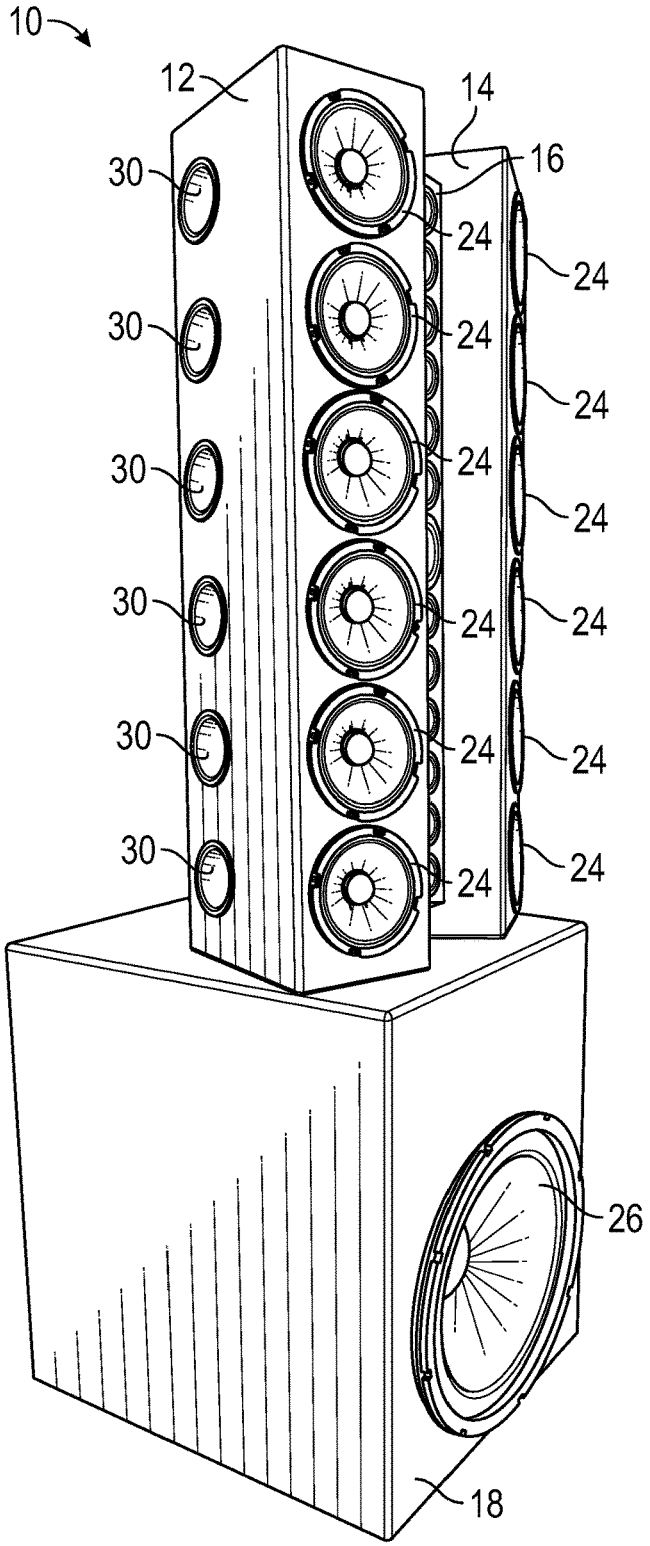
FIG. 6 shows a perspective view of a representative loudspeaker.

FIGS. 4-6 provide additional views of loudspeakers 10. FIG. 4 shows a front perspective view of a pair of loudspeakers 10. In this view, the various drivers may be readily seen, with a super tweeter 20 visible at the center of the third, centrally located, vertically disposed array of drivers in the third enclosure 16. The remaining drivers of the third vertically disposed array of drivers are tweeters 22, with six tweeters 22 above the super tweeter, and with six tweeters 22 below the super tweeter. Thus, there are a total of thirteen drivers in the third vertically disposed array of drivers, one super tweeter 20 and twelve tweeters 22.

As discussed above, each of the first and second vertically disposed arrays of drivers in the first and second enclosures 12, 14 are mid-bass drivers 24. In this example, each of the first and second vertically disposed arrays of drivers includes six mid-bass drivers 24, so there are a total of twelve mid-bass drivers 24 in each loudspeaker 10. As may be appreciated, this number of mid-bass drivers 24 matches the number of tweeters 22 in the loudspeaker, though the mid-bass drivers 24 are divided into two separate vertically disposed arrays that are horizontally spaced apart and outwardly directed as discussed above. In contrast, the tweeters 22 are essentially divided into two separate vertically disposed subarrays that are vertically spaced apart (and separated by the super tweeter 20) instead of being horizontally spaced apart, and the subarrays are on-axis with a primary axis of the loudspeaker 10.

As discussed above, the subwoofer enclosure 18 houses a single subwoofer 26, which in this example is oriented facing forward. As is known in the loudspeaker art, low-frequency sound is less directional than is high-frequency sound, and in some embodiments of the invention, the subwoofer 26 is oriented in a different direction, such as downward, rearward, or to one of the sides.

FIG. 5 shows an enlarged perspective view of the three vertically disposed arrays of drivers in their respective enclosures 12, 14, and 16. This Figure also illustrates the offset orientation of the first and second enclosures 12, 14 from the direction of the third enclosure 16, which is on-axis with the loudspeaker 10. At the right edge of the second enclosure 14 as seen in FIG. 5, are ports 30 for each of the mid-bass drivers 24.

The ports 30 are more easily visible in FIG. 6, which represents a front-side perspective view of the representative loudspeaker 10. As may be seen in FIG. 6, the ports 30 are generally outward firing. In the illustrated example, the ports 30 of the first vertically disposed array of drivers in the first enclosure 12 are visible. The ports 30 of the second vertically disposed array of drivers in the second enclosure 14 are opposite the point of view and are therefore hidden, but are generally symmetrical with the ports 30 of the first vertically disposed array of drivers in the first enclosure 12. As is illustrated in FIG. 6, the ports 30 are generally oriented in a direction generally orthogonal to the axis of the first vertically disposed array of drivers, and are thus directed rearward at an angle approximately equal to the angle at which the first enclosure 12 is oriented, in this case approximately twenty-two and one-half degrees rearward. It should be understood, however, that other orientations or directionalities of the ports 30 may be used as may be desired.

The specific characteristics of the exemplary loudspeaker 10 and other versions discussed herein are provided by way of example only. The present invention may be embodied in other specific forms without departing from its spirit or essential characteristics. The described embodiments are to be considered in all respects only as illustrative and not restrictive. The scope of the invention is, therefore, indicated by the appended claims, rather than by the foregoing description. All changes which come within the meaning and range of equivalency of the claims are to be embraced within their scope.

What is claimed and desired to be secured by Letters Patent is:

1. A loudspeaker comprising:

a first vertically disposed array of drivers contained in a first enclosure, the first vertically disposed array of drivers comprising drivers selected from the group consisting of midrange drivers and mid-bass drivers and all of a single type and size;

a second vertically disposed array of drivers contained in a second enclosure, the second vertically disposed array of drivers comprising drivers all of the single type and size of the drivers of the first vertically disposed array of drivers; and a third vertically disposed array of drivers contained in a third enclosure, the third vertically disposed array of drivers comprising a single vertically centered super tweeter and equal numbers of a single type and size of tweeters above and below the super tweeter;

wherein the third enclosure is located horizontally between the first and second enclosures.

2. The loudspeaker as recited in claim 1, wherein the first vertically disposed array of drivers and the second vertically disposed array of drivers are directed off-axis from a primary direction of the third vertically disposed array of drivers.

3. The loudspeaker as recited in claim 2, wherein the first vertically disposed array of drivers and the second vertically disposed array of drivers are each directed at opposite angles from the primary direction of the third vertically disposed array of drivers at an angle of between about fifteen degrees and about thirty degrees from the primary direction of the third vertically disposed array of drivers.

4. The loudspeaker as recited in claim 2, wherein the first vertically disposed array of drivers and the second vertically disposed array of drivers are each directed at opposite angles from the primary direction of the third vertically disposed array of drivers at an angle of between about twenty degrees and about twenty-five degrees from the primary direction of the third vertically disposed array of drivers.

5. The loudspeaker as recited in claim 2, wherein the first vertically disposed array of drivers and the second vertically disposed array of drivers are each directed at opposite angles from the primary direction of the third vertically disposed array of drivers at an angle of about twenty-two and one-half degrees from the primary direction of the third vertically disposed array of drivers.

6. A loudspeaker comprising:

a first vertically disposed array of drivers contained in a first enclosure;

a second vertically disposed array of drivers contained in a second enclosure; and a third vertically disposed array of drivers contained in a third enclosure;

wherein the third enclosure is located horizontally between the first and second enclosures;

wherein the first vertically disposed array of drivers and the second vertically disposed array of drivers are directed off-axis from a primary direction of the third vertically disposed array of drivers; and wherein the third vertically disposed array of drivers is recessed relative to the first vertically disposed array of drivers and the second vertically disposed array of drivers to cause impulses from the first, second, and third vertically disposed arrays of drivers to arrive at an on-axis listening position simultaneously.

7. The loudspeaker as recited in claim 1, further comprising a subwoofer located below the first, second, and third vertically disposed arrays of drivers.

8. The loudspeaker as recited in claim 1, wherein the first and second enclosures are ported.

9. The loudspeaker as recited in claim 8, wherein the first and second enclosures each comprise an outward-firing port for each of the drivers contained in the first and second enclosures.

10. The loudspeaker as recited in claim 9, wherein the first and second enclosures each comprise dividers between each of the drivers in the respective vertically disposed array of drivers.

11. The loudspeaker as recited in claim 1, wherein:

the first vertically disposed array of drivers and the second vertically disposed array of drivers each comprise an equal number of drivers selected from the group consisting of:

two drivers per array;
three drivers per array;
four drivers per array;
five drivers per array;
six drivers per array;
seven drivers per array; and
eight drivers per array;

the third vertically disposed array of drivers comprises a number of drivers selected from the group consisting of:

four drivers;
five drivers;
six drivers;
seven drivers;
eight drivers;
nine drivers;
ten drivers;
eleven drivers;
twelve drivers;
thirteen drivers;
fourteen drivers;
fifteen drivers;
sixteen drivers; and
seventeen drivers.

12. A loudspeaker comprising:

a first vertically disposed array of drivers contained in a first enclosure and a second vertically disposed array of drivers contained in a second enclosure, the first vertically disposed array of drivers and the second vertically disposed array of drivers comprising drivers having a first, lower fundamental frequency; and a third vertically disposed array of drivers contained in a third enclosure, the third vertically disposed array of drivers comprising drivers having a second fundamental frequency that is higher than the first, lower fundamental frequency;

wherein the third enclosure is located horizontally between the first and second enclosures; and wherein the third vertically disposed array of drivers comprises a number of drivers having the second fundamental frequency that is equal to a sum of the drivers having the first, lower fundamental frequency in the first and second vertically disposed array of drivers.

13. The loudspeaker as recited in claim 12, wherein the third vertically disposed array of drivers further comprises a driver having a third fundamental frequency that is higher than the second fundamental frequency.

14. A loudspeaker comprising:

a vertical plane of general left-to-right symmetry;

a first vertically disposed array of drivers located leftward of the vertical plane of left-to-right symmetry and each directed at an angle leftward from the vertical plane of general left-to-right symmetry;

a second vertically disposed array of drivers located rightward of the vertical plane of left-to-right symmetry and each directed at an angle rightward from the vertical plane of general left-to-right symmetry; and a third vertically disposed array of drivers disposed in a vertically oriented space horizontally located between the first and second vertically disposed arrays of drivers and centered on the vertical plane of general left-to-right symmetry and each directed along the vertical plane of general left-to-right symmetry.

15. The loudspeaker as recited in claim 14, wherein the first vertically disposed array of drivers and the second vertically disposed array of drivers are each directed at opposite angles from the primary direction of the third vertically disposed array of drivers at an angle of between about fifteen degrees and about thirty degrees from the primary direction of the third vertically disposed array of drivers.

16. The loudspeaker as recited in claim 14, wherein the first vertically disposed array of drivers and the second vertically disposed array of drivers are each directed at opposite angles from the primary direction of the third vertically disposed array of drivers at an angle of about twenty-two and one-half degrees from the primary direction of the third vertically disposed array of drivers.

17. The loudspeaker as recited in claim 14, wherein the third vertically disposed array of drivers is recessed relative to the first vertically disposed array of drivers and the second vertically disposed array of drivers to cause impulses from the first, second, and third vertically disposed arrays of drivers to arrive at an on-axis listening position simultaneously.

18. The loudspeaker as recited in claim 14, wherein the first vertically disposed array of drivers and the second vertically disposed array of drivers comprise drivers having a first, lower fundamental frequency and wherein the third vertically disposed array of drivers comprises drivers having a second fundamental frequency that is higher than the first, lower fundamental frequency.

19. The loudspeaker as recited in claim 18, wherein the third vertically disposed array of drivers comprises a number of drivers having the second fundamental frequency that is equal to a sum of the drivers having the first, lower fundamental frequency in the first and second vertically disposed array of drivers.

20. The loudspeaker as recited in claim 1, wherein the third vertically disposed array of drivers is recessed relative to the first vertically disposed array of drivers and the second vertically disposed array of drivers to cause impulses from the first, second, and third vertically disposed arrays of drivers to arrive at an on-axis listening position simultaneously.

* * * * *